US007036294B2

(12) United States Patent
Kempsell et al.

(10) Patent No.: US 7,036,294 B2
(45) Date of Patent: May 2, 2006

(54) SADDLE CLOTHS

(76) Inventors: David Kempsell, Little Duskin Farm, Covet Lane, Kingston, Canterbury, Kent CT4 6JS (GB); Margaret L. White, Little Duskin Farm, Covet Lane, Kingston, Canterbury, Kent CT4 6JS (GB)

( * ) Notice: Subject to any disclaimer, the term of this patent is extended or adjusted under 35 U.S.C. 154(b) by 0 days.

(21) Appl. No.: 10/471,349

(22) PCT Filed: Mar. 27, 2002

(86) PCT No.: PCT/GB02/01185

§ 371 (c)(1),
(2), (4) Date: Feb. 18, 2004

(87) PCT Pub. No.: WO02/076877

PCT Pub. Date: Oct. 3, 2002

(65) Prior Publication Data

US 2004/0128959 A1 Jul. 8, 2004

(30) Foreign Application Priority Data

Mar. 27, 2001 (GB) ..... 0107582

(51) Int. Cl.
*B68C 1/12* (2006.01)

(52) U.S. Cl. ..... 54/82
(58) Field of Classification Search ..... 54/66, 54/65, 44.6; D30/134
See application file for complete search history.

(56) References Cited

U.S. PATENT DOCUMENTS 3,343,338 A * 9/1967 Stübben ..... 54/44.6
4,683,709 A 8/1987 Vasko et al.

(Continued)

FOREIGN PATENT DOCUMENTS

DE 298 00 448 4/1998

(Continued)

OTHER PUBLICATIONS

International Search Report No. PCT/GB02/01185, dated Jan. 10, 2003, 6 pages.

*Primary Examiner*—Teri Pham Luu
*Assistant Examiner*—Bret Hayes
(74) *Attorney, Agent, or Firm*—Connolly Bove Lodge & Hutz LLP; Larry J. Hume

(57) ABSTRACT

The present invention relates to improvements in or relating to saddle cloths, pads or numnahs, particularly for horses. In one aspect, there is described a saddlecloth comprising a sheet material having a longitudinal spine (81) defining left and right saddlecloth sections; wherein each section includes at least one pocket (84, 85) housing at least one cushioning element comprising a bladder (30,31) and resilient element (38), wherein the bladder (30) is formed of a substantially inelastic material and is adapted for inflation and deflation with air or other fluid medium. Preferably, the pocket (84) in each section is a longitudinally elongate and houses two or more bladders (30, 31) dimensioned so as to overlap within the pocket (84) such that, when inflated, the bladders (30, 31) present a substantially uniform thickness. A modification for a saddlecloth for a side-saddle is also described. In a second aspect there is also described a saddlecloth locking element or plate (90) comprising a central portion including securing means (91) for securing to a saddlecloth and comprising at least two opposing wings or arms extending radially therefrom from the central portion. There is also described a method of securing a saddlecloth to the underside of a saddle using said locking element or plate (90).

12 Claims, 5 Drawing Sheets

U.S. PATENT DOCUMENTS

| | | | | |
|---|---|---|---|---|
| 5,027,589 | A * | 7/1991 | Gleb et al. | 54/66 |
| 5,330,249 | A * | 7/1994 | Weber et al. | 297/214 |
| 5,548,948 | A | 8/1996 | Smith et al. | |
| 5,555,710 | A * | 9/1996 | Smith | 54/66 |
| 5,782,070 | A | 7/1998 | Knight et al. | |
| 5,787,692 | A * | 8/1998 | Purdy | 54/66 |
| 6,050,067 | A * | 4/2000 | Knight et al. | 54/44.6 |
| 6,272,817 | B1 * | 8/2001 | Further | 54/44.1 |
| 6,481,189 | B1 * | 11/2002 | Bates | 54/44.6 |
| 6,619,019 | B1 * | 9/2003 | Bates | 54/44.6 |

FOREIGN PATENT DOCUMENTS

| | | |
|---|---|---|
| DE | 200 03 746 U1 | 9/2000 |
| EP | 0 764 607 A1 | 3/1997 |
| FR | 2670769 A1 | 6/1992 |
| GB | 2090512 | 7/1982 |
| WO | WO-98/29331 | 7/1998 |

* cited by examiner

SADDLE CLOTHS

The present invention relates to improvements in or relating to saddle cloths, pads or numnahs, particularly for horses.

It is problem to ensure that a saddle conforms well to the shape of a horse's back. Even when a saddle fits a horse well, over the course of a year, changes in the diet of the horse or its fitness will result in changes in muscle structure and the shape of the back, with the result that a saddle which fitted well earlier in the year is no longer so well fitting. At the least, this will cause the horse discomfort and at worst could result in lameness.

A common solution is to place a padded saddlecloth or numnah between the saddle and the horse. There are many different types of pads on the market designed to correct the fit of a saddle on a horse that has changed in the shape of its back. Some of these solutions are outlined in the patents we cite below and over which we claim inventive step.

The trouble with all these variants is they address the problem of the saddle's fit in a general way, making the assumption that the saddle does not fit throughout the whole of its length. This is not, in fact, normally the case, as most saddle fitting problems occur at the front or the back of the saddle only. By using a pad to correct one area, excessive pressure can be placed in another.

Another problem to bear in mind is that the saddlecloth, numnah or pad bridges the spine and wither areas of the horse's back. When the horse is ridden, the saddlecloth or other padding will move under the saddle. It is quite normal that the cloth will be pulled taut across the withers and spine due to the panel of the saddle bearing down on either side of the withers and spinal processes. The saddlecloth etc. will then restrict movement of the horse, cutting into it and will therefore will be a contributing factor to saddle soreness.

The problems with saddles are not always wholly associated with the way it fits the horse's shape, as much as the way it can influence the position the rider assumes, making them unbalanced.

It is with a view to overcoming these disadvantages in the prior art that the present invention has been devised. In particular, it has been an aim of the inventors to provide a means of balancing and improving the fit of a saddle which does not fit the animal's back as comfortably as it should, whilst also retaining the appearance of the traditional saddlecloth or numnah. The present invention is designed not only to improve the fit of the saddle but to do so without causing pressure points along either the spine of the horse, due to the pad slipping or being pulled down or along the muscle of the horse's back on which the saddlecloth and panels of the saddle sit.

An unbalanced rider will not ride a horse, sympathetically and can cause undue pressure or strain on the horse's back. The present invention is designed so the rider can adjust the saddlecloth whilst seated on the horse to find the optimum riding position and balance for the saddle. The balance of the saddle can be adjusted both front to back and side to side as necessary. The invention can be used in conjunction with all types of riding saddle whether English, Western or Spanish.

EP0764607 describes a means of adapting the panels of a saddle with an air and foam bladder system, which allows the saddler to adjust the saddle to the correct fit and balance. But a system in this form cannot address an ill-fitting saddle's problems because the system relies on the saddle fitting the horse in the first instance.

In the present invention we utilize the technology of the combination of air bags and foam within a saddlecloth for the purpose of making an adjustable cloth that will make an ill fitting saddle fit the horse's back better. Embodiments of the invention allow this combination of air bags and foam to be incorporated in a saddlecloth with pockets to house the air bags and foam whilst also overcoming the problem of keeping this type of system in place under the saddle when incorporated in a saddlecloth. We address this problem by a unique method of holding the numnah in place up and into gullet of the saddle thus alleviating pressure directly on the horse's spine and allowing for better ventilation along the spine.

The use of air bladders in saddlecloths is not new. Saddle pads are produced in many different variants, which incorporate foams, air, gel and material padding. However as we have proven in the technology revealed in our patent EP0764607, air alone does not provide the flat bearing surface required between saddle pad and horse and in fact creates ridges of high pressure which are undesirable and cause discomfort to the horse. The patents that are closest to our invention are outlined in applications DE29800448U (Boehm Sabine), FR2670769 (Daniel Frouin), GB2090512 (Schaupp Hans Juerfg Christoph), U.S. Pat. No. 5,782,070 (Kathrin Bridges), U.S. Pat. No. 5,555,710 (Scott Smith), U.S. Pat. No. 5,548,948 (Scott Smith), U.S. Pat. No. 4,683,709 (Vasko Tanya) and lastly WO98/29331 (Vernon), which is considered to be the closest prior art.

All the above disclosures utilize air or similar media alone but this has been shown by pressure testing to be deficient in dispersing pressures evenly as claimed across the horse's back.

In a first aspect of the present invention there is provided a saddlecloth including a plurality typically two or more, pockets on each side of the spine of the saddlecloth being that part of the saddlecloth which will, in use, be adjacent to the spine of the horse. At least some of the pockets are provided with at least one bladder and foam insert. The foam insert may external or provided within the bladder. Preferably, the bladders and foam inserts are removable from the pockets created in the saddlecloth to facilitate washing the cloth without damage to the bladders. Preferably, the bladders and foam inserts are insertable into the respective pockets through openings in the saddlecloth. Preferably, the openings are sufficiently large that it is not necessary to deflate the bags when removing the bladders. The bladders with foam inserts are suitably provided in matching pairs, being divided into left and right side corresponding to the sides of the saddlecloth. Adjacent, bladders within a saddlecloth preferably overlap each other such that if front and rear pairs are used together the transfer of pressure is kept constant throughout the length of the panel and does not create a gap in the bearing surface. Air can be adjusted in each pair of bladders so they may find their own level and equalise the saddle's bearing surface on the horse's back by the use of a pump, a valve sealing each bladder once a rider is satisfied the saddle fits correctly.

Preferably, two pairs of bladders are provided, each pair suitably referred to as a rear bladder pair and a pommel bladder pair by reference to the correspondingly adjacent areas of the saddle.

In a second aspect, the present invention also provides a method and apparatus for holding a saddlecloth in place under a saddle. The apparatus comprises at least one locking plate, suitably generally elongate in appearance, securable to an upper surface of a saddlecloth, the locking plate being adapted to engage and be retainable by the underside of a saddle. Preferably three plastics, or material having similar characteristics, spinal locking pieces are provided.

More specifically, according to the present invention, there is provided, in a first aspect, a saddlecloth comprising a sheet material having a longitudinal spine defining left and right saddlecloth sections; wherein each section includes at least one pocket housing at least one cushioning element comprising a bladder and resilient element, wherein the bladder is formed of a substantially inelastic material and is adapted for inflation and deflation with air or other fluid medium.

Preferably, each resilient element is provided within the respective bladder.

More preferably, the at least one pocket in each section is a longitudinally elongate pocket. Advantageously, the longitudinally elongate pocket houses a plurality of bladders dimensioned so as to overlap within the pocket such that, when inflated, the bladders present a substantially uniform thickness. More advantageously, each longitudinal pocket houses two overlapping bladders.

In one embodiment, of particular use in combination with a side-saddle, in at least one of the saddlecloth sections, a further or side-saddle pocket remote the spine of the saddlecloth is provided housing a further cushioning element, suitably of generally U-shaped appearance.

Typically, the resilient element is a foamed material.

In a second aspect, the present invention provides a saddlecloth locking element or plate comprising a central portion including securing means for securing to a saddlecloth and comprising at least two opposing wings or arms extending radially therefrom from the central portion. Typically the locking element or plate is formed of a resiliently deformable material, such as a plastics material, suitably polypropylene.

In a third aspect, there is also provided a method of securing a saddlecloth to the underside of a saddle comprising a saddle tree and saddle panels, the method comprising securing a locking element or plate as described above to a saddlecloth and inserting the wings or arms between the saddle tree and an adjacent saddle panel. Suitably a plurality of such locking elements or plates are secured along a spine of the saddlecloth.

Advantageously, the bladders are fillable with air or other gas due to the advantages of weight and fluidity of movement of this medium.

The above and other aspects of the present invention will now be illustrated in further detail, by way of example only, with reference to the accompanying figures in which.

Figure 1:
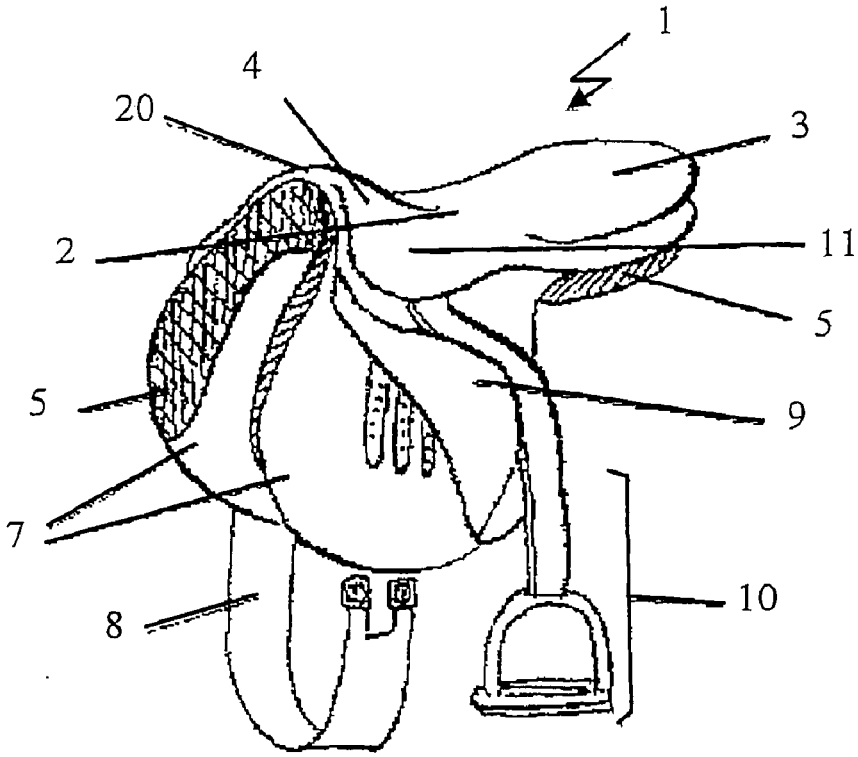
FIG. 1 illustrates a conventional English style saddle in a side view.
Figure 2:
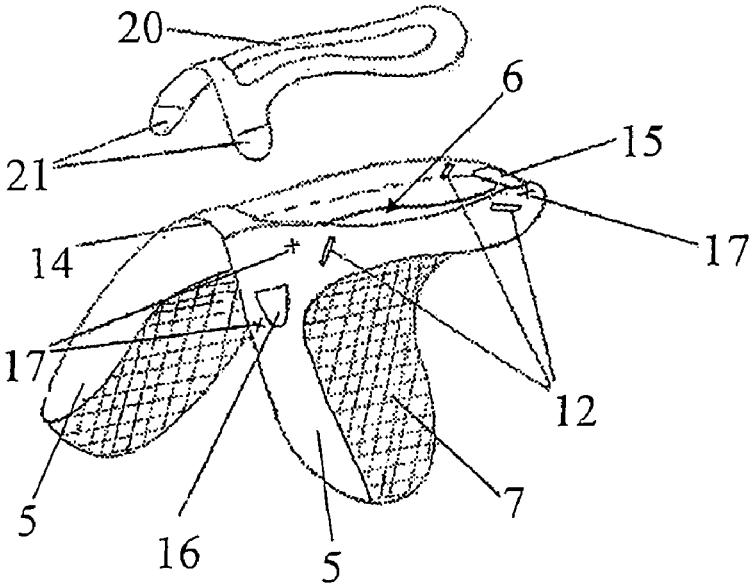
FIG. 2 illustrates internal components of a conventional English saddle in exploded view.

To illustrate the present invention, it is convenient to outline the construction of a conventional saddle as is shown in FIGS. 1 & 2. The saddle 1 comprises a seat 2 rising at the rear of the saddle to form cantle 3, and at the front forming pommel 4 formed over the tree 20 allowing a gap between the saddle and the withers of the horse, to ensure that the saddle does not inhibit movement. The underside of the saddle is formed in to a generally 'L' shaped panel 5 on either side of a gullet 6, which sits over the horse's spine; and panel flaps 7 which serve to protect the horse's skin from rubbing against the girth strap 8 by which the saddle is secured to the horse's back. A seat flap 9 protects the rider from the girth strap and the stirrup 10 is attached to a hook (not shown) between the seat flap 9 and a stirrup flap or skirt 11 of the seat 2.

A conventional saddle is made in two pieces:

1. a seat section, which includes seat 2, cantle 3, pommel 4, tree 20, tree points 21, seat flaps 9 and stirrup flaps 11, and
2. a panel section, which consists of panels 5 with flocking holes 12 with pommel gusset 14 and rear gusset 15, which connect the panels together and tree pockets 16. The tree pockets 16 enclose the tree points 21 when the two sections are brought together aiding their adhesion to one another.

The two sections are stitched together at the front and back of the saddle with the tree points 21 inserted in the tree pockets 16. The stitching at the back of the saddle connects the exposed rear section of the panel 5 and rear gusset 15 to the cantle 3. At the front, the pommel of the seat section is stitched to the matching area of the panel section including the pommel gusset 14. Starting adjacent to the tree pocket on one side, stitching runs over the pommel to the corresponding position on the other side of the saddle.

In a wholly conventional arrangement, wadding or flocking is inserted into the panels 5 on either side of the saddle 1 through one or more flocking holes 12.

It is the characteristics of the tree 20 combined with the flocking that achieves the fit of the saddle 1 for the horse's back. The tree 20 at the pommel area 4 must conform to the shape of the horse at the wither 44 (FIGS. 7 and 8) very accurately and must also follow the sweep of the back longitudinally. The flocking is used within the L shaped panels 5 to elevate the tree above the horse forming a cushion that separates the tree 20 from the back of the horses. The saddler's skill in flocking a saddle 1 involves keeping the flocking consistent whilst still following the form of the tree and the horses' back.

A problem with flocking is that over time the flocking can compress and also the horse can change shape so altering the "fit" of the saddle to the horse. It must be observed that if a horse gets fatter, broader or wider in the wither area 44, then the arch of the saddle tree at the pommel area 4 will start to pinch the wither area. There is no cure for this apart from to widen the arch of the saddle so the saddle tree 20 conforms again to the shape of the horse.

The present invention is particularly applicable to those instances in which:

1. the tree of the saddle is wider in the pommel area 4 than is the horse;

2. the balance of the saddle tips the rider backwards because the cantle 3 end of the saddle 1 does not sit high enough off the horse's back, or
3. a combination of both situations i.e. where a saddle rocks front to back because the bearing surface of the saddle is focussed in the middle portion of the panels; or
4. where a saddle bridges in the centre i.e. the front and the back portions of the panel of the saddle touch the horse's back but does not touch in the middle.

Figure 8:
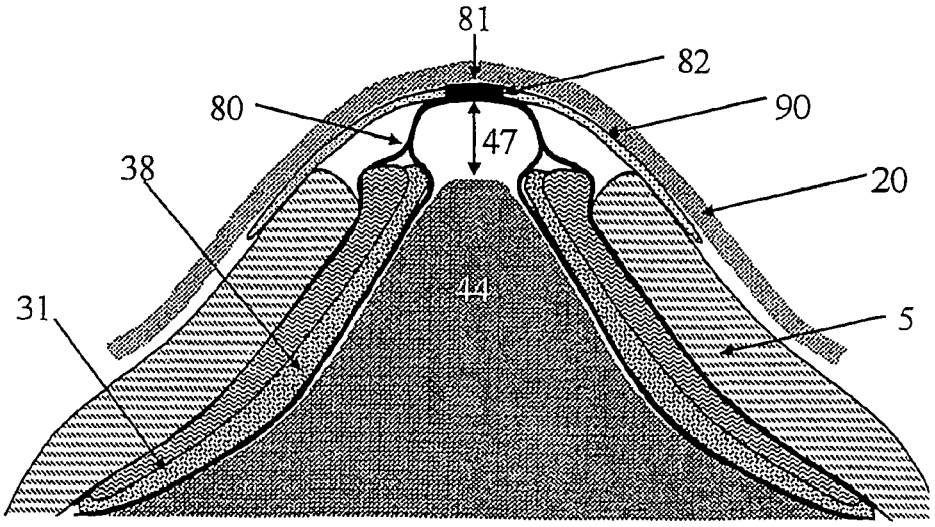
FIG. 8 illustrates the relationship between horse's wither, the bladders and pommel of the saddle.

As an example of instance 1, where the tree is wider in the pommel area 4 than the horse, it can be seen from FIG. 8 that if a saddlecloth 80 of the invention with the bladders 30,31 were removed from under the panel 5 the tree 20 would be able to drop on to the wither 44 of the horse.

Figure 4:
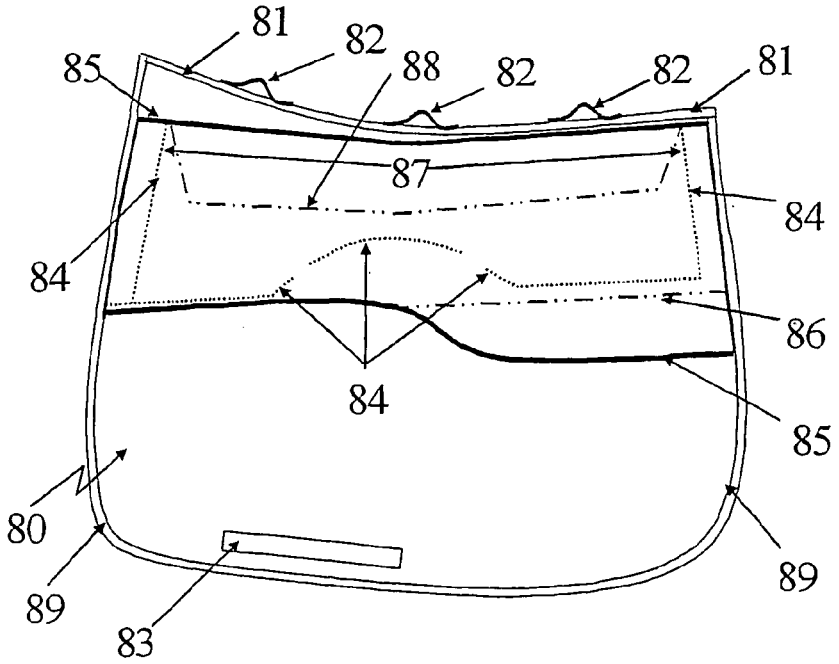
FIG. 4 illustrates the arrangement of the saddlecloth incorporating the bladders of FIG. 3 (left side only)
Figure 5:
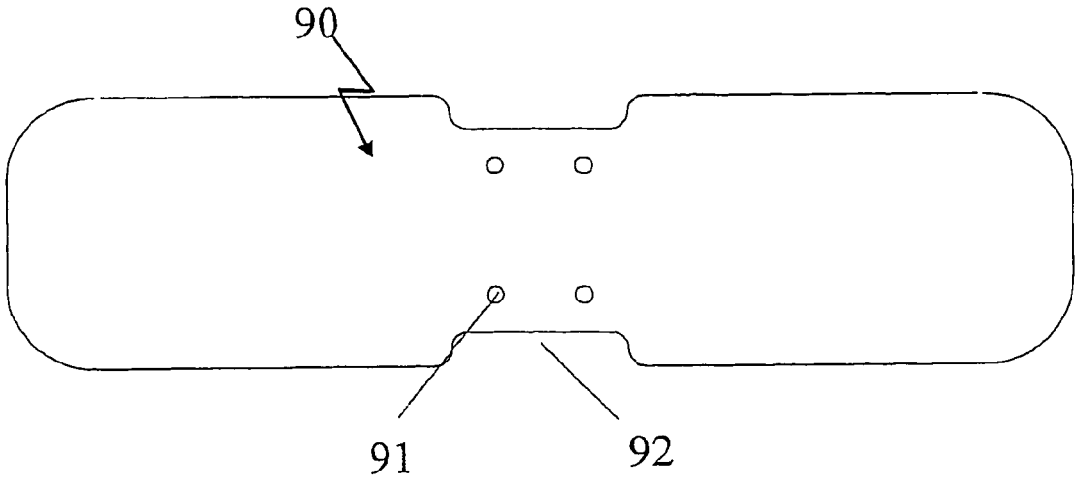
FIG. 5 shows in plan view an embodiment of a saddlecloth locking plate in accordance with the second aspect of the present invention.

FIG. 4 illustrates schematically the embodiment of the present invention in which a saddlecloth 80 with a spine 81 made of webbing has loops 82 of the same webbing at conveniently spaced at intervals along it to locate gullet locking plates so the spine of the cloth when fitted to the saddle is pulled up into the central channel of the saddle called the gullet 6.

The saddlecloth is typically made of a heavy duty cotton or polyester cotton drill quilted with a wadding of around 5 oz in weight. This quilted material will be used for the saddlecloth 80, the bladder pocket 85, bladder pocket flap 88 and tube pocket 86. The shape of the bladder pocket is bordered by the line 84, which represents the stitch line that forms the pocket in board of the material shape 85. The bladder pocket flap is represented by the dotted line 88. This flap 88 is stitched to the bladder pocket 85 along the line 85 where the two material shapes join. This creates an opening not unlike an envelope which can be opened along the whole of its length 87. This facilitates easy insertion and removal of the bladders 30,31 from the saddlecloth. The seam between material 85 and 88 is not straight but has a kink or undulation near to the centre of the saddlecloth this encourages the "envelope" to stay closed when in use. The flap 88 is large enough that it can be tucked in to the pocket formed by the stitching 84 under the bladders 30,31 so that the weight of the saddle and rider pressing down on the saddlecloth 80 will hold the flap closed.

In a practical embodiment, the bladders will be approximately 50 mm in from the front and back edges of the saddlecloth and have an overall length along spine 81 of approximately 600 mm. The overall length 87 of the pocket 84,85 is typically of the order of 500 mm. Clearly, it will be necessary commercially to have various lengths of saddlecloth and therefore bags/bladders to suit the different sizes of saddles available, so the product would be offered in small, medium or large.

The stitching 84 forms pockets and channels that route inflation and deflation tubes 33 of bladders 30,31 to a concealed pocket 86 between the material shape 85 and the main saddlecloth 80 at the rear of the saddlecloth on either side of it. The tubes 33 are suitably at least 750 mm long so that they can be extended from the pockets 86 on either side of the saddlecloth and brought to the riders lap when sitting in the saddle on the horse. In this way the tubes 33 can be connected to the pump via valve 50. Pocket 86 is dimensioned sufficiently to accommodate this length of tubing easily.

Bladders 30,31 and foam sheet 38 are provided in each pocket of the saddlecloth 80. The foam sheet 38 is approximately 10 mm in thickness with shock absorbent qualities that works in the region of 50% compression at 1.5–2.5 lbs per square inch and is inserted into the pocket 84,85 before the bladders 30,31 are inserted on top of this foam 38. It has been demonstrated through electronic pressure testing equipment that foam with these properties works best in conjunction with an air bladder system. It may be necessary to provide different grades of foam dependent on rider's weight and/or discipline. In a practical embodiment, the sheet foam 38 properties could be distinguished by colour, so the rider with reference to a table correlating riders weight against discipline i.e. show jumping, dressage, etc could select the correct foam sheet for their use.

In certain instances where the bearing surface of the panel 5 is deemed to be too narrow, it is possible to increase this bearing surface by introducing a stiffener 93 suitably of a polypropylene material into the bladder pocket 84,85 so it sits above the bladders 30,31. The thickness of this stiffener will suitably be between 1–2 mm as this provide rigidity to disperse a rider's weight but still be sufficiently flexible so as not to affect the horse.

Bladders 30,31 and a resilient element in the form of foam sheet 38 are provided in each pocket of the saddlecloth 80; a rear bladder 30, a pommel bladder 31 are inserted through the opening 87. This opening 87 is large enough as to allow the bladders 30,31 and foam sheet 38 to be removed without letting the air out of the bladders so the adjustments can be kept between washing the saddlecloth and re-using. The bladders may be inflated by means of respective hoses 33, which are attached to the bladders via a spigot formed on the bladders and are sealed with a luer type commercial gaseous sealing fitting 34 and plug. (Note: a luer is a push interference fit connection where two tubes are connected together by pushing one inside the other The inner tube is tapered with the start of the taper being smaller than the ID of the pipe it is being pushed into and the end of the taper being larger. Therefore at some point along the taper the two pipes will fit interface precisely giving a tight seal.)

Bladders 30,31 ideally have a flat, having a substantially two-dimensional, shape not having any significant characteristics of depth. Materials suitable for manufacture of the bladders have good abrasion resistance whilst being supple enough to form perfectly within the panel but not have elastic characteristics (as this induces a bouncing effect which is undesirable). PVC is a highly suitable material for the bladders. Such bladders can be formed using a dip moulding process in the same way that rubber gloves are manufactured and in this way the spigot for the tube 33 can be produced at the same time. The advantage of this process is that the closing seam to form a bladder is minimized to just one side or edge of the bladder. The open end of the bladders can then be closed using high frequency, radio, welding to form a sealed unit.

The bladders sit under the panel 5 and in practice should be no longer than 25 mm greater in their combined length than the front to back length of the panel 5. If the panel 5 is much shorter, the bladder will inflate like a balloon where they are not under the panel and, whilst the working efficiency will not be compromised the aesthetics of the saddlecloth will be undesirable. It is therefore preferable commercially to manufacture different sizes of bag for the differing sizes (length of panel) of saddle. In practice there will probably be two or three sizes of each bladder to cover the various sizes of saddle from pony to large horse.

There will be a commercial need to manufacture different shaped bladders for the pommel area 4 of the saddle panel 5 to take into account the shape of panel for the different disciplines i.e. Jumping and Dressage saddles.

Figure 10:
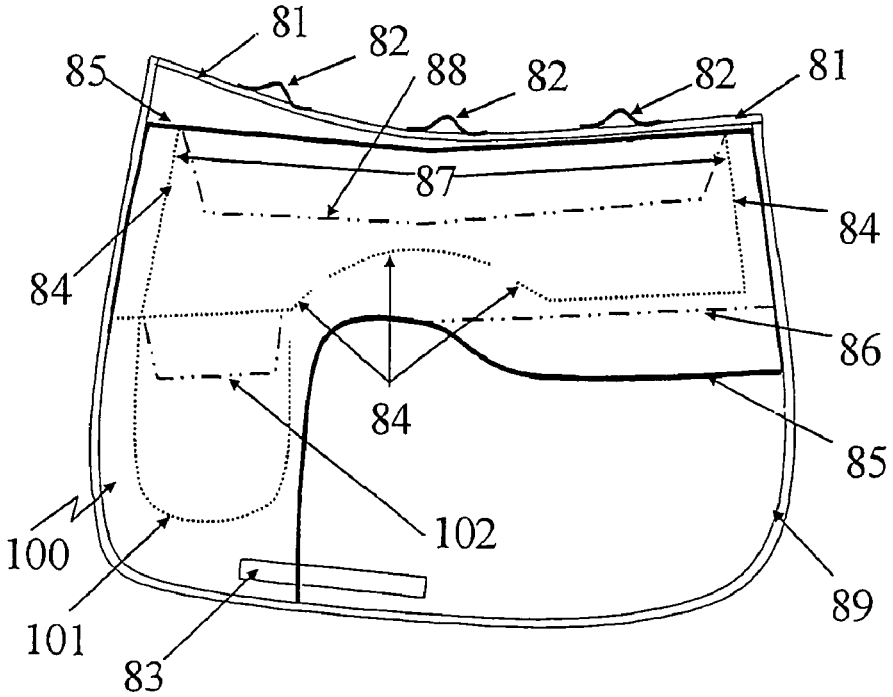
FIG. 10 illustrates an arrangement of an embodiment of a saddlecloth adapted for a side-saddle (left side only) including an additional $5^{th}$ bag.

FIG. 10 illustrates a modification of the design described above applied to a saddle cloth for a ladies sidesaddle. A fifth "U" shaped bladder is provided in a separate pocket 101 on the left side of the saddlecloth 100 directly under the pommel bladder 31. With a sidesaddle the rider sits with both legs to the left side of the saddle (some right hand saddles exist but are rare). Unlike normal, astride, saddles the sidesaddle requires that the support surface of the saddle panel 5 under the pommel area to extend much further down and around the left side of the horse. This extension to the panel is commonly known as the long point as the tree 20 also extends over this region. It is only used on sidesaddles and is adjusted separately by the saddler using flocking. This adjustment is crucial for the balance of rider and saddle. By the introduction of a fifth bladder under the long point this adjustment of the long point can also be facilitated by the saddlecloth.

Figure 6:
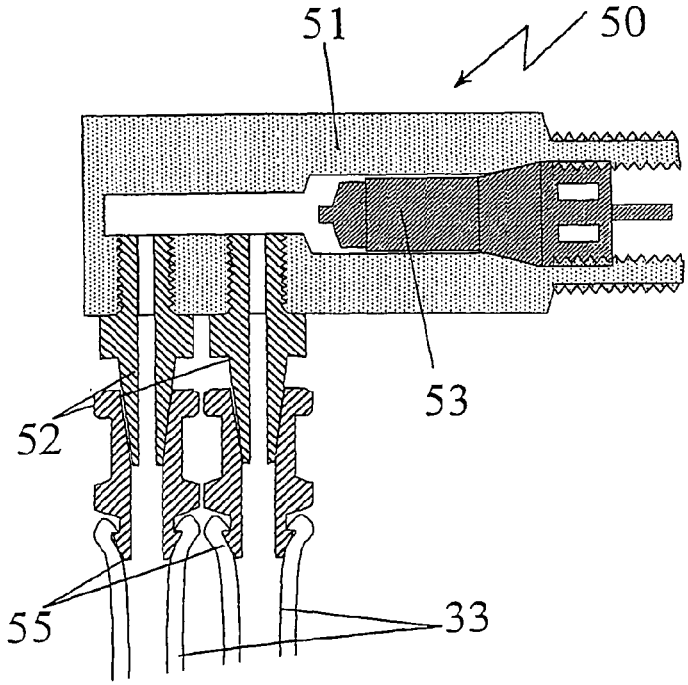
FIG. 6 illustrates a valve and pipe assembly adapted for use with the embodiment of FIG. 4.
Figure 9:
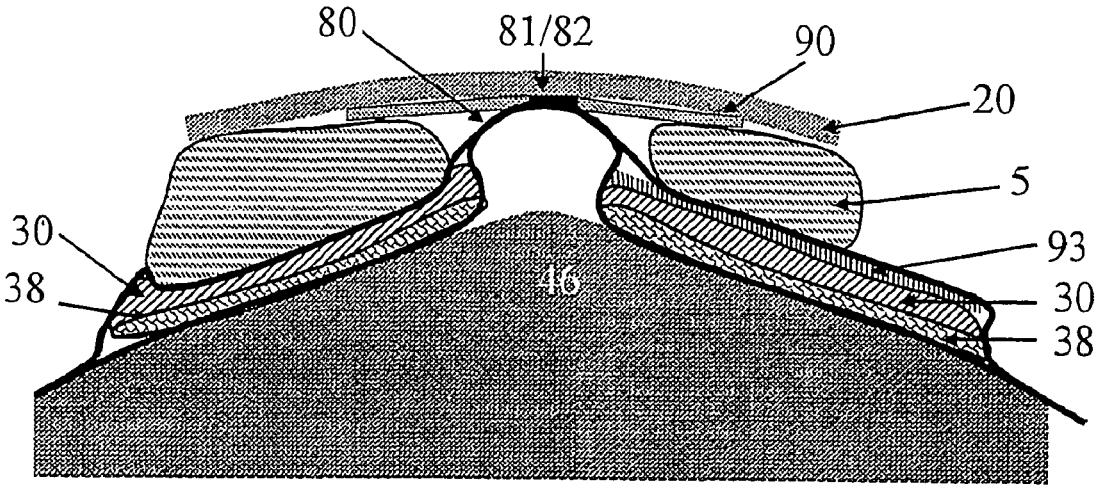
FIG. 9 is a comparative illustration of the relationship between a horse's back and the saddlecloth bladders towards the rear of the saddle in which the right-hand side shows a narrow saddle panel with polypropylene stiffener in the present invention whilst the left-hand side shows a panel with sufficient bearing surface.

In order to prevent movement of the saddlecloth with respect to the saddle, the saddlecloth is fitted with rigid pieces of rectangular plastic 90 which we shall refer to as saddlecloth locking plates (FIG. 6. For example, a plate approximately 150 mm×50 mm×6 mm is provided for the rearmost webbing loop 82 of the saddlecloth. The saddlecloth locking plates 90 are suitably made of polypropylene and attach to the saddlecloth by being pushed through webbing loops 82 on the spine of the saddlecloth 81, being that part of the saddlecloth that runs along the spine of the horse. The locking are fixed on their centres perpendicularly to the spine of the cloth and engage and are received between the tree 20 the upper surface of the saddle panels 5 thereby holding the spine of the cloth clear of the spine of the horse (as shown in FIG. 8). The plates 90 have small central re-entrant portions 92 so the cloth will not slide to one side when in use. The plates, when in place on the saddlecloth, are offered up into the gullet of the saddle 6 lengthways, between the panels 5 and rotated so that the plate spans the gullet jammed between the tree 20 and the panel 5, To hold a saddle cloth in place will typically require a minimum of one plate at the rear of the saddlecloth; the maximum number of plates need not normally be greater than 3. The further towards the front of the saddle 4 the longer and more curved the plate will typically be to give clearance to the wither 44 as in FIG. 8. FIG. 9 illustrates how the plate 90 compares with profile 46 which is at the rear of the saddle adjacent to the cantle 3 is much flatter and shorter.

Locking plates 90 are equally suitable for use in securing a conventional saddlecloth to a saddle. The inclusion of holes 91 makes it possible to stitch plates 90 onto the cloth negating the need for webbing loops 82 to be provided along the spine of a saddlecloth. This forms a separate aspect of the present invention.

As illustrated in FIG. 8, a horse's back changes in shape (cross section) as one looks at the back in sections moving from the withers 44 (over which the pommel 4 sits), through section 45 (on which the front of the seat 2 of the saddle sits), to section 46 (on which the rear of the seat 2 of the saddle sits).

As illustrated in FIG. 8 the withers 44 are nearer to the vertical at their uppermost point and form a hollow at their base. Therefore the pommel bladders 31 must form themselves to either side of this irregular bearing surface to enable the pommel 4 and tree 20 of the saddle to be borne 40–50 mm (47) above the horse's wither 44.

The nature of the muscle and bone structures in this region means that the cross sectional shape of the withers will constantly change as the horse moves. The pommel bladder will give a more fluid and soft feeling to the horse in this region allowing it move its muscle mass without being impeded or bruised were the saddlecloth not to be present.

It should be noted that there is no need to use, or inflate, both pairs of bladders if they are not required. As previously stated we do wish to add unnecessary bull to the parts of the saddle that do not require it. In this way the saddlecloth 80 can be tailored to meet a specific horse's needs by using either the front 31 or the back 30 pair of bladders only as desired.

As shown, the preferred arrangement of the present invention is to have two bladders on each side of the saddlecloth 80. Inflation of opposing pairs of bladders is essential to accurate adjustment of the saddle with respect to the horse's back i.e. the pressure on both sides of the back bone is the same. For this reason, each pair of bladders are advantageously linked in the fitting process via a single valve assembly 50. For example, rear bladders link to a first valve, pommel bladders to a second and optionally a side-saddle bladder to a third.

Figure 3:
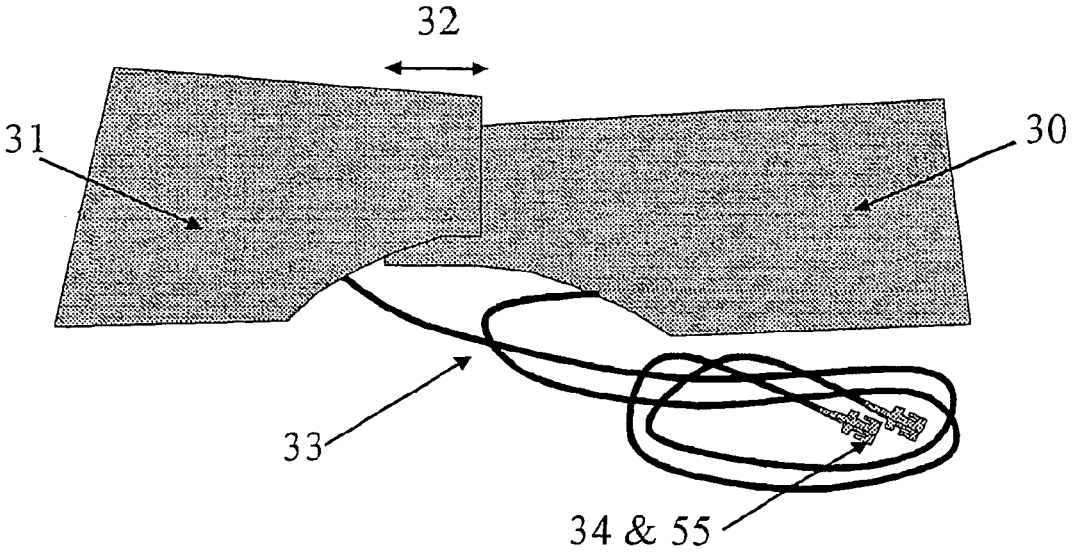
FIG. 3 illustrates an arrangement of first bladders as they would lay in a left side pocket of an embodiment of the saddlecloth of the present invention.

With reference to FIGS. 3 and 6, the tubes to the bags can be individually sealed using a stopper 34 arrangement typically of plastic, that is readily available on the market through various manufacturers. By removing the plug from the stopper it is possible to replace this plug with a through connection 55 which in turn connects to the valve 50. The valve 50 has two entries and hence two places to connect tubes 33 via connectors 55 on the valve 50 therefore the pairs bladders 30 or 31 can be connect together via the valve for adjustment.

Figure 7:
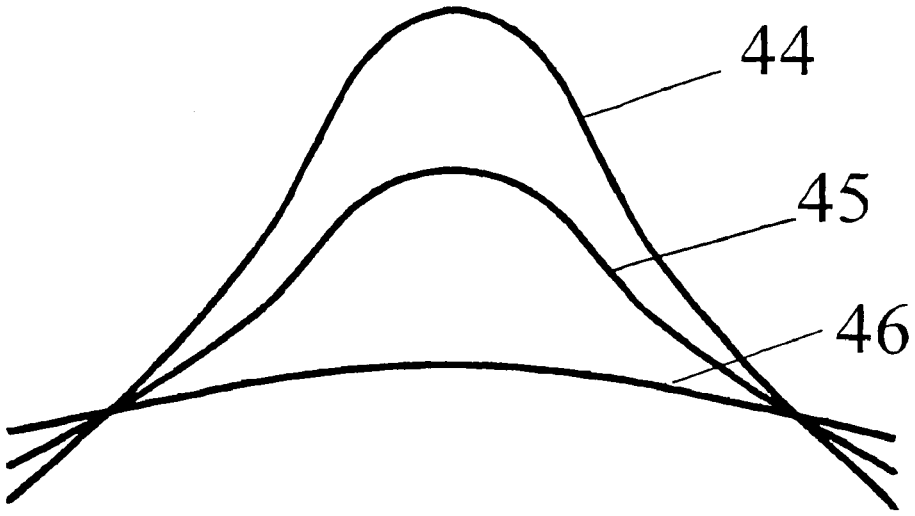
FIG. 7 illustrates the differing shapes of the back of a horse at different points along the back.

FIG. 7 illustrates a valve 50 for a non-side-saddle saddlecloth of the present invention, which acts as a manifold for the air. Equal amounts of air are passed to each bladder in a pair i.e. rear or pommel. The valve 50 consists of a valve body 51 incorporating a Schrader type valve 53 as is commonly used on cars and motorbikes. The valve body 51 is suitably made of nylon. Air can be blown into the valve body via an ordinary bicycle-type pump and hence to the bladders 30,31 through valve 53. Air can be removed from the bladders via conventional Schrader valve 53 when the pin 53*a* is depressed. Valve body 51 has two pipe connectors 52 which allow a push fit air tight seal against tube fitting 55 to which tubes 33 of the bladders are permanently connected. This type of fitting is know as a luer fitting, the valve entry 52 being a male luer and the tube 33 fitting being a female luer 55. The female luer fittings 55 can be fitted with a plug 34 that can be locked into place for sealing the tube 33 when the pump is not connected and hence giving four individually sealed bags.

If it becomes necessary to alter a single one bladder, a sealing clamp can be closed over the pipe 33 that requires to be sealed, thereby facilitating irregular inflation. When adjustment of the air in the bladders has been achieved, the same clamps (not shown) may be used to close both tubes 33 so the stoppers 34 can be fitted without air loss to the system. Clamps of the type used to temporarily close plastic food bags to keep the content fresh, they offer a cost effective solution to closing the pipes whilst changing over from pump to stopper. Obviously tubes 33 will require a certain degree of deformability to allow compression by the clamps. Tubes made of flexible PVC are preferred. Also the use of PVC tubing allows the tubes to be bonded into a compatible material at the bladder spigot.

When a rider wishes to re-adjust the saddlecloth he will first remove the plug 34 from the female luer 55 and connect both tubes to the valve body pipe entries 52. So no air will be lost in the transfer between the plug to the valve the tubes 33 are crushed flat using a clamp which is released once the valve body is connected.

With the rider mounted on the horse, air will either be pumped into the bladders via Schrader valve 53 (using a standard bicycle pump) or let out of the bladders (by releasing the Schrader valve 53) until the saddle has the desired fit. All of the adjustments are checked by eye and feel.

The present invention provides, inter alia, the following advantages.

1. It is possible to use only the pair of bags that are required i.e. front or rear so minimizing the bulk under those parts of the saddle that fit well and therefore minimise the chance of adding extra pressure on the horses back in these areas.
2. By means of additional shock-absorbing inserts, the saddlecloth can be tuned to the riders' weight and discipline.
3. It provides a means of overcoming the problems of keeping the cloth in place under the saddle when a fluid medium like air is used in a saddlecloth. The method allows the cloth to be securely fixed to the saddle without modification to the saddle whilst at the same time facilitating a quick and easy method of removal.
4. It provides an optional means of increasing the bearing surface of a saddle's panel by use of a stiff plate within the saddlecloth fitted so that it floats over the bladders and foam.

The present invention is suitable for use with in any style of saddle and types of saddle, be it western riding, racing, eventing, dressage, show jumping, endurance, hunting and general recreation and so on as long as the saddle fits or has a wider fitting tree than the horse requires and/or is out of balance. The saddlecloth of the present invention may also include an additional stiffener element to add rigidity.

What is claimed is:

1. A saddlecloth comprising:

a sheet material having a longitudinal spine defining left and right saddlecloth sections;

wherein each section includes at least one pocket housing at least one cushioning element comprising a plurality of bladders and at least one resilient element wherein each bladder is formed of a substantially inelastic material which is inflatable and deflatable with air or other fluid medium, wherein the at least one pocket in each section comprises a longitudinally elongate pocket, wherein each longitudinally elongate pocket houses a plurality of bladders dimensioned so as to overlap within the pocket such that, when inflated, the bladders present a substantially uniform thickness; and wherein the saddlecloth further comprises:

at least one locking element or plate comprising a central portion to which the sheet material is secured, and wherein at least two opposing wings or arms extend from the central portion.

2. A saddlecloth as claimed in claim 1 wherein each resilient element is provided within a respective bladder.

3. A saddlecloth as claimed in claim 1, wherein each pocket houses two overlapping bladders.

4. A saddlecloth as claimed in claim 1 further comprising in at least one of the saddlecloth sections, a further or side-saddle pocket remote from the spine of the saddlecloth and housing a further cushioning element.

5. A saddlecloth as claimed in claim 4 wherein the further cushioning element is of generally U-shaped appearance.

6. A saddlecloth as claimed in claim 1 wherein the resilient element is a foamed material.

7. A saddlecloth according to claim 1, wherein the locking element or plate is formed of a resiliently deformable material.

8. A saddlecloth according to claim 7 wherein the locking element or plate is formed of a plastics material.

9. A saddlecloth as claimed in claim 8, wherein the locking element or plate is formed of a polypropylene.

10. A saddlecloth locking element or plate comprising:

a saddlecloth comprising a sheet material having a longitudinal spine defining left and right saddlecloth sections, wherein each section includes at least one pocket having at least one cushioning element comprising a plurality of bladder and at least one resilient element, each bladder being formed of a substantially inelastic material which is inflatable and deflatable;

wherein the at least one pocket in each section comprises a longitudinally elongate pocket, wherein each longitudinally elongate pocket houses a plurality of bladders dimensioned so as to overlap within the pocket such that, when inflated, the bladders present a substantially uniform thickness; and a central portion including securing means for securing to a the sheet material formed of a resiliently deformable plastic material and further comprising at least two opposing wings or arms extending radially from the central portion.

11. A saddlecloth comprising a sheet material having a longitudinal spine defining left and right saddlecloth sections, wherein each section includes at least one pocket housing at least one cushioning element comprising a plurality of bladder and at least one resilient element, each bladder being formed of a substantially inelastic material which is inflatable and deflatable; and wherein the at least one pocket in each section comprises a longitudinally elongate pocket, wherein each longitudinally elongate pocket houses a plurality of bladders dimensioned so as to overlap within the pocket such that, when inflated, the bladders present a substantially uniform thickness; and at least one locking element or plate secured to a the sheet material, said at least one locking element or plate comprising a central portion including securing means for securing to a the sheet material having at least two opposing wings or arms inserted between a saddle free and an adjacent saddle panel of a saddle.

12. A saddlecloth according to claim 11 comprising a plurality of locking elements or plates secured along said longitudinal spine of the saddlecloth.

* * * * *